US006866400B2

(12) United States Patent
Wood et al.

(10) Patent No.: US 6,866,400 B2
(45) **Date of Patent: *Mar. 15, 2005**

(54) FLASHLIGHT EQUIPPED WITH LOW WATTAGE ARC LAMP

(75) Inventors: Robert J. Wood, Syracuse, NY (US); Lorand Ernyey, Skaneateles, NY (US); John Harkins, Baldwinsville, NY (US)

(73) Assignee: Welch Allyn, Inc., Skaneateles Falls, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 630 days.

(21) Appl. No.: 09/249,922

(22) Filed: Feb. 12, 1999

(65) Prior Publication Data

US 2002/0080611 A1 Jun. 27, 2002

Related U.S. Application Data

(60) Provisional application No. 60/074,606, filed on Feb. 13, 1998.

(51) Int. Cl.[7] ..... F21L 4/00

(52) U.S. Cl. ..... 362/263; 362/195

(58) Field of Search ..... 362/263, 296, 362/282, 276, 265, 195, 261, 538; 313/620

(56) References Cited

U.S. PATENT DOCUMENTS

| | | | | | |
|---|---|---|---|---|---|
| 4,914,356 | A | * | 4/1990 | Cockram et al. | 315/307 |
| 5,034,663 | A | * | 7/1991 | Cook et al. | 315/307 |
| 5,144,201 | A | * | 9/1992 | Graham et al. | 313/634 |
| 5,604,406 | A | * | 2/1997 | Gaus | 315/56 |
| 5,630,661 | A | | 5/1997 | Fox | 362/187 |

* cited by examiner

*Primary Examiner*—Sandra O'Shea
*Assistant Examiner*—Ali Alavi
(74) *Attorney, Agent, or Firm*—Wall Marjama & Bilinski LLP

(57) ABSTRACT

A hand-held flashlight comprising a metal halide arc lamp operating between 8 and 22 watts. The lamp has an arc gap of between 0.7 and 1.4 mm and a color temperature at or above 5000° Kelvin. The lamp contains a fill gas including mercury and indium in percentages to produce a point source of white light capable of penetrating dense smoke and fog. The flashlight includes a reflector containing the arc lamp and providing a collimated beam of high intensity white light. The flashlight includes a circuit for providing a high starting voltage to the lamp and a lower operating voltage after sustaining the lamp. The circuit includes a battery, a ballast, and a microprocessor for monitoring the lamp and the battery. The microprocessor provides a discernible output signal indicative of the lamp on-time and battery voltage. The microprocessor controls the application of the starting voltage from the ballast to the lamp to prevent misstarting of the lamp.

1 Claim, 2 Drawing Sheets

FLASHLIGHT EQUIPPED WITH LOW WATTAGE ARC LAMP

CROSS REFERENCE TO RELATED APPLICATION

This application claims priority from U.S. Provisional Application No. 60/074,606 filed Feb. 13, 1998, the entirety of which is incorporated herein by reference.

BACKGROUND OF THE INVENTION

This invention relates to a hand-held flashlight, and in particular, to a flashlight for use by a firefighter or the like which provides a beam of light that is capable of penetrating dense smoke or fog to a greater extent than flashlights that are presently in use.

Most flashlights that are presently used by firefighters, rescue personnel and others that are forced to deal with fire, utilize tungsten-halogen lamps that inherently produce light that is concentrated at wavelengths in the red portion of the visible spectrum. As a consequence, the output of the lamp appears yellow when compared to natural white light. The light therefore is not able to penetrate dense smoke to any great extent and the user typically is unable to identify objects such as doors, windows, stairways and the like at any appreciable distance.

A low wattage arc lamp has been developed by Welch Allyn, Inc. of Skaneateles Falls, N.Y. and is described in detail in U.S. Pat. No. 5,144,201 to Graham et al., the disclosure of which is incorporated herein by reference. Lamps of the type described in the noted patent have been built which are capable of producing almost natural white light with the lamp output being substantially uniform at wavelengths across the visible spectrum. A 21 watt lamp is now available in which the gap between the lamp electrodes is about 1.2 mm. The arc which is generated within this small gap approaches a point light source and exhibits high efficacy even at very low wattages. As will be explained below, this type of lamp when incorporated in a battery operated, hand-held flashlight is able to penetrate heavy smoke to enable the user to identify objects at distances unattainable by present day flashlights equipped with tungsten-halogen lamps.

A rechargeable metal arc flashlight is disclosed in U.S. Pat. No. 5,630,661 which employs a 24 watt arc lamp that is mounted inside a reflector for focusing the light output of the lamp upon a light diffusion screen which is fixed in position in front of the lamp. The screen uniformly distributes the light from the reflector over a wide area. Light from the screen is then passed through a collimating lens and a UV filter mounted in front of the lens element. The relative position of the lens with regard to the lamp may be varied to change the spot size of the flashlight. A ballast is mounted inside the flashlight housing which controls starting and sustaining the arc.

Although the flashlight disclosed in the '661 patent is an advancement in the art, the many optical elements mounted in front of the lamp reduces the power output of the lamp and lessens the device's ability to focus the output of the lamp into a concentrated spot. In addition, the flashlight lacks a number of safety features that are essential when dealing with hazardous situations. Some of these include the ability to restrike the lamp arc in the event it is extinguished while involved in an emergency. As is well known, if the arc is restruck too soon after it has been extinguished, the starting procedure will be adversely impacted and a rapid restart cannot be thereafter initiated. As a result, a person who is involved in dense smoke or the like can well find himself or herself unable to restart the arc lamp when it is most needed.

Other information relating to safety and operability of the lamp are also not found in prior art flashlights. This includes the amount of on-time experienced by the lamp which, of course, goes to the expected life of the lamp. Here again, a flashlight having a dying lamp is of little use to a person who is involved in an emergency situation. In the case of smoke, a lamp that might be still functional under normal usage can undergo spatial changes that will adversely effect its ability to penetrate dense smoke. Similarly, the condition of the battery must also be monitored to insure that sufficient battery life is available to survive an emergency.

SUMMARY OF THE INVENTION

It is therefore a primary object of the present invention to improve portable, handheld lights used by firefighters, rescue workers or the like that must deal with smoke or fog.

It is a further object of the present invention to provide a flashlight that produces a concentrated beam of light that can penetrate dense smoke or fog to a greater degree than presently available lights.

A still further object of the present invention is to provide a flashlight employing an arc lamp that is tuned to produce a point source of white light that is capable of penetrating smoke or fog to a distance heretofore unattainable.

Another object of the present invention is to provide a battery powered flashlight that is equipped with an arc lamp that is capable of generating a high intensity point source of white light at very low wattage.

Yet another object of the present invention is to provide a portable arc lamp that has built-in safety features that will provide the user with valuable safety information concerning the operability of the light.

These and other objects of the present invention are attained by means of a battery operated portable flashlight utilizing a low watt lamp that is ideally suited for use in emergency situations involving dense smog or fog that normally cannot be penetrated by most prior art low wattage light sources. The lamp is a metal halide arc lamp capable of operating at about 21 watts or less. The lamp has an extremely short arc gap that is between 0.7 and 1.4 mm so that the light produced in the gap acts as a point source of energy. The fill gases used to dope the lamp are primarily mercury and indium that, depending upon the wattage of the lamp, function to produce a color temperature in excess of 5000° Kelvin whereby the lamp output approaches white light. The flashlight is further equipped with a cadmium lithium battery having a long life and a microprocessor capable of monitoring battery voltage and lamp on-time. In addition, the microprocessor is arranged to control the lamp ballast which supplies power to the lamp to strike an arc and to sustain the arc after it has been struck. The microprocessor is programmed to prevent restriking of the arc during a critical period during which an attempted restrike will adversely affect the ballast and delays a restart for a considerable period of time.

BRIEF DESCRIPTION OF THE DRAWINGS

For a better understanding of these and other objects of the present invention, reference will be made to the following detailed descriptions of the invention which is to be read in association with the accompanying drawings, wherein.

DETAILED DESCRIPTION OF THE INVENTION

Figure 1B:
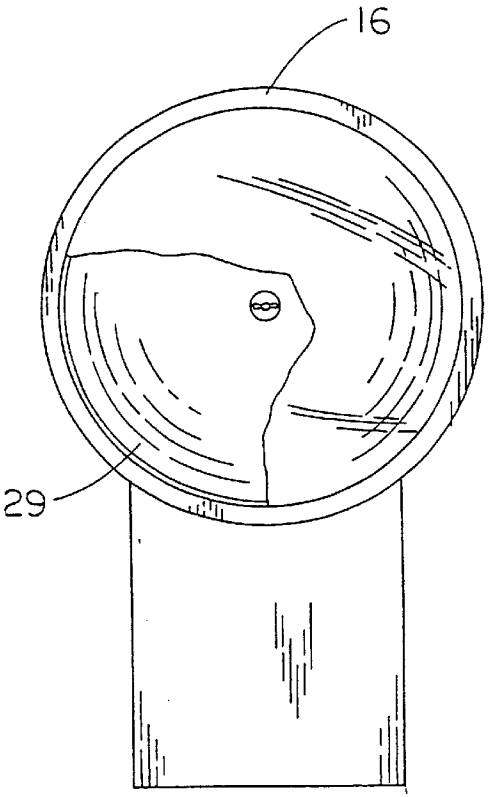
FIG. 1*b* is a front side elevation, in partial section, showing a portable flashlight embodying the teachings of the present invention.

With reference to the drawings, there is shown a portable flashlight, generally referenced 10, that includes a main housing 12 to which a carrying handle 13 is connected by a pair of raised end supports 14 and 15. A reflector assembly 16 is pivotally connected to the front end support by means of a ball and socket connector 17 so that the reflector assembly can be positioned to direct a beam of light emanating from the reflector upon a desired target.

Figure 2:
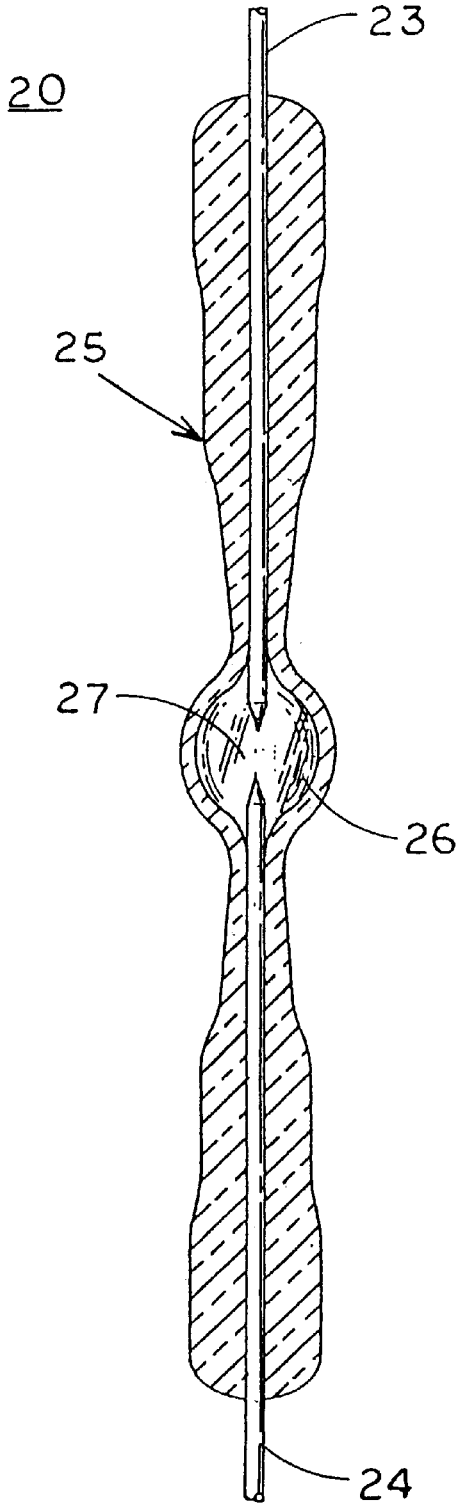
FIG. 2 is an enlarged side view of a low wattage arc lamp suitable for use in the lamp illustrated in FIG. 1.

A metal halide arc lamp 20, which is shown in greater detail in FIG. 2, is mounted inside the reflector. The lamp is a low wattage discharge device capable of achieving an extremely high efficacy at input ratings of between 8 and 22 watts. A pair of tungsten electrodes 23 and 24 are passed inwardly through the opposed neck sections of the quartz envelope 25. The tips of the electrodes penetrate into the arc chamber 26 of the envelope and are brought into close proximity with one another. An extremely small arc gap 27 is established between the tips. Preferably, the arc gap is between 0.7 and 1.4 mm depending on the lamp wattage so that the arc that is struck between the electrodes approaches a point source of high intensity light.

The arc chamber contains a fill gas whose primary constituents are mercury and indium. The actual quantity of each element within a specific lamp is dependent upon lamp wattage, lamp size and the thermal losses in the lamp so that the lamp color temperature produced by the lamp is greater than 5000° Kelvin and preferably about 5700° Kelvin. Accordingly, the light output of the lamp is uniformly concentrated within the visible spectrum and produces substantially white light. The output is rich in the blue and green spectral regions when compared to other lamps. This offers significant enhancement in the light's ability to visually discern objects in dense smoke and fog.

It has been demonstrated that a low wattage arc lamp of the type described above has an output of 30 lumens per watt. Although it is not thoroughly understood, it has been further shown through tests conducted by Applicants that the high intensity beam of light produced by a lamp of the type described above with an enhanced spectral response in the shorter wavelengths produces a spot of light that can penetrate dense fog and smoke to a greater depth than presently achievable by more conventional tungsten halogen lamps. In fact, the present lamp has an intensity that is greater than three times that of a halogen lamp of comparable wattage.

Figure 1A:
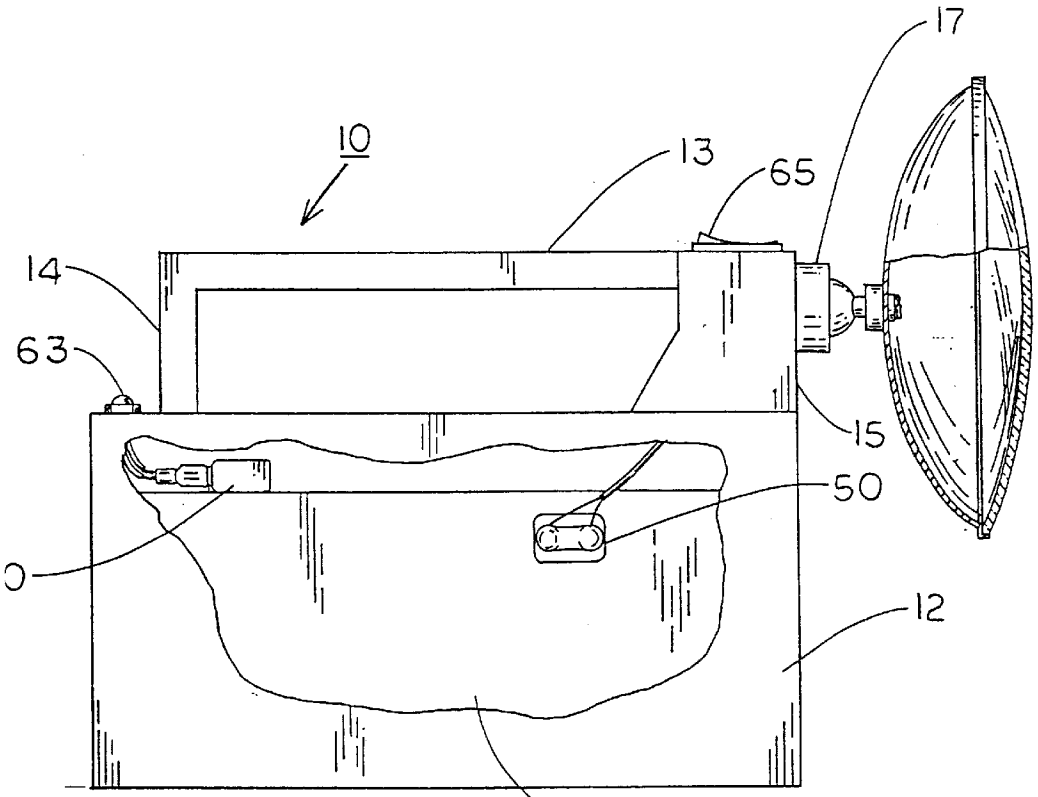
FIG. 1*a* is a side elevation, in partial section, showing a portable flashlight embodying the teachings of the present invention.

Furthermore, light from the present arc lamp that emanates from the short gap greatly enhances the reflector's ability to gather the light into a well defined intense beam capable of penetrating dense smoke and fog. The lamp reflector shown in FIG. 1 includes a parabolic dish 29 that has been contoured to reflect the light from the point source into a high intensity concentrated beam of collimated light without the need of additional, oftentimes complex optical components.

The housing 12 of the flashlight contains a long life rechargeable cadmium lithium battery 32 of known construction which is well able to power the low wattage lamp. A ballast 50 is connected through appropriate circuitry to the lamp and the battery. A ballast of this type is described in U.S. Pat. No. 5,291,100, the disclosure of which is herein incorporated by reference. The low wattage lamp is controlled by a switching and voltage regulation circuit in the ballast which serves to adjust the duty cycle and an oscillator and driver which are coupled to a ballast transformer. The transformer is wound to provide for starting and sustaining the lamp arc after starting. The ballast also contains a compensating circuit which adjusts the power delivered to the lamp to compensate for the aging of the lamp.

The ballast also contains an emergency shutdown circuit that places the ballast in an off condition until such time as the entire ballast network is powered down prior to restarting the lamp in the event the lamp has been turned off. This circuit prevents repetitive restart cycles which can be dangerous under certain conditions. In emergency situations, where time is important, the user of the flashlight will invariably attempt to repeatably restart the lamp at short intervals which, because of the ballast shutdown circuitry, will not produce the desired results. After a number of failed restart attempts, the ballast circuitry can become damaged and the lamp will fail.

The present flashlight is equipped with a microprocessor 60 that monitors the lamp, the ballast and the battery to insure that the flashlight is in proper working order before it is put into operation under potentially hazardous conditions.

The microprocessor is adapted to monitor the battery voltage and provide an indication at window 63 when the battery voltage falls below a predetermined value. This predetermined voltage, in the case of a flashlight intended for use under hazardous conditions, will be greater than that tolerated under more normal operating conditions. The microprocessor also monitors lamp on-time and provides an indication at window 63 when the on-time reaches a certain predetermined value. Here again, because the lamp is intended for use under hazardous conditions, the predetermined on-time will be less than that of a lamp that is intended for use under normal conditions and thus provides a safety factor that will avoid a premature failure.

The microprocessor is further connected to the lamp on/off switch 65 and is programmed to prevent the lamp from being restruck until such time as the lamp and the ballast are in a condition to successfully carry out a restart.

While this invention has been explained with reference to the structure disclosed herein, it is not confined to the details set forth and this invention is intended to cover any modifications and changes as may come within the scope of the following claims:

What is claimed is:

1. A hand-held flashlight comprising:

a metal halide arc lamp, said lamp operating between 8 and 22 watts, said lamp having an arc gap of between 0.7 and 1.4 mm and a color temperature at or above 5000° Kelvin, said lamp containing a fill gas including mercury and indium in percentages wherein said lamp produces a point source of white light capable of penetrating dense smoke and fog;

a reflector containing said arc lamp and providing a collimated beam of high intensity white light; and, circuit means for providing a high starting voltage to the lamp and a lower operating voltage after sustaining said lamp, said circuit means including a battery, a ballast, and a microprocessor for monitoring said lamp and said battery, said microprocessor providing a discernible output signal indicative of the lamp on-time and battery voltage, said microprocessor controlling the application of the starting voltage from said ballast to said lamp to prevent misstarting of the lamp.

* * * * *